US007223120B2

(12) United States Patent
Ko

(10) Patent No.: US 7,223,120 B2
(45) Date of Patent: May 29, 2007

(54) CABLE ASSEMBLY WITH FLAT FLEXIBLE CABLE

(75) Inventor: David (Tso-Chin) Ko, Fullerton, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/175,000

(22) Filed: Jul. 5, 2005

(65) Prior Publication Data

US 2007/0010124 A1 Jan. 11, 2007

(51) Int. Cl.
*H01R 12/24* (2006.01)

(52) U.S. Cl. ..... 439/492; 439/497; 439/579

(58) Field of Classification Search ..... 439/492, 439/495, 497, 579
See application file for complete search history.

(56) References Cited

U.S. PATENT DOCUMENTS

D444,130 S 6/2001 Hayashi et al.
6,305,978 B1 10/2001 Ko et al.
6,338,652 B1 1/2002 Ko
D456,777 S 5/2002 Igarashi
D457,138 S 5/2002 Igarashi
6,685,495 B1 * 2/2004 Ko ..... 439/353
6,843,679 B2 * 1/2005 Kuo et al. ..... 439/497

* cited by examiner

*Primary Examiner*—X. Chung-Trans
(74) *Attorney, Agent, or Firm*—Wei Te Chung

(57) ABSTRACT

A cable assembly (1) includes an electrical connector (200), an insert (23) and a Flat Flexible Cable (300). The electrical connector comprises an insulative housing (21) and a plurality of terminals (24). The insert is inserted into the insulative housing and comprises a plurality of holes (235) formed in a front face (232) thereof, and a depressing portion (233) forming a plurality of slits (237), and a plurality of slots (238) aligned with corresponding holes and slits. The FFC comprises a plurality of separated conductive members (301), the front ends of the separated conductive members are disposed in the slits and the slots, and each terminal comprises a connecting portion (243) disposed in the slot of the insert, and being soldered with corresponding conductive member of FFC.

13 Claims, 8 Drawing Sheets

1

CABLE ASSEMBLY WITH FLAT FLEXIBLE CABLE

BACKGROUND OF THE INVENTION

1. Field of the Invention

The present invention relates to a cable assembly, and particularly to a cable assembly having an Flat Flexible Cable (FFC).

2. Description of the Prior Art

Flat Flexible Cables (FFC) are widely used to connect components arranged in a confined space inside an electronic device, such as a notebook computer, for deducing the overall size of the electronic device. A conventional FFC connector assembly usually comprises an insualtive housing, a plurality of contacts received in the insualtive housing and an FFC assembled to the insulative housing and electrically connecting with the contacts.

Normally, each Flat Flexible Cable consists of a plurality of separated flat conductive members, each having a rectangular section and a pair of insulative layers covering the opposite faces of the conductive members. The conductive members extending beyond the front ends of the insulative layers form contacting portions. The FFC is light and thin. As above reason, during the contacting portions are inserted into the insualtive housing and then soldered to the corresponding contacts, FFC is hard to be positioned and the solder with the contacts is also hard to realize. Further, after solder, the solder joints achieved do not have good quality, and thus, influence the signal transmission.

Hence, an improved FFC cable assembly is desired to overcome the disadvantages of the prior art.

BRIEF SUMMARY OF THE INVENTION

Therefore, a main object of the present invention is to provide a FFC cable assembly, which the FFC can be easily and precisely soldered to the contacts so that the good quality solder joints can be achieved.

In order to implement the main object and overcome the above-identified deficiencies in the prior art, a cable assembly comprises an electrical connector, an insert and a Flat Flexible Cable. he electrical connector comprises an insulative housing and a plurality of terminals. The insert is inserted into the insulative housing and comprises a plurality of holes formed in a front face thereof, and a depressing portion forming a plurality of slits, and a plurality of slots aligned with corresponding holes and slits. The FFC comprises a plurality of separated conductive members, the front ends of the separated conductive members are disposed in the slits and the slots. Each terminal comprises a connecting portion disposed in the slot of the insert, and soldered with corresponding conductive member of FFC.

Other objects, advantages and novel features of the invention will become more apparent from the following detailed description when taken in conjunction with the accompanying drawings.

DETAILED DESCRIPTION OF THE PREFERRED EMBODIMENT

Figure 1:
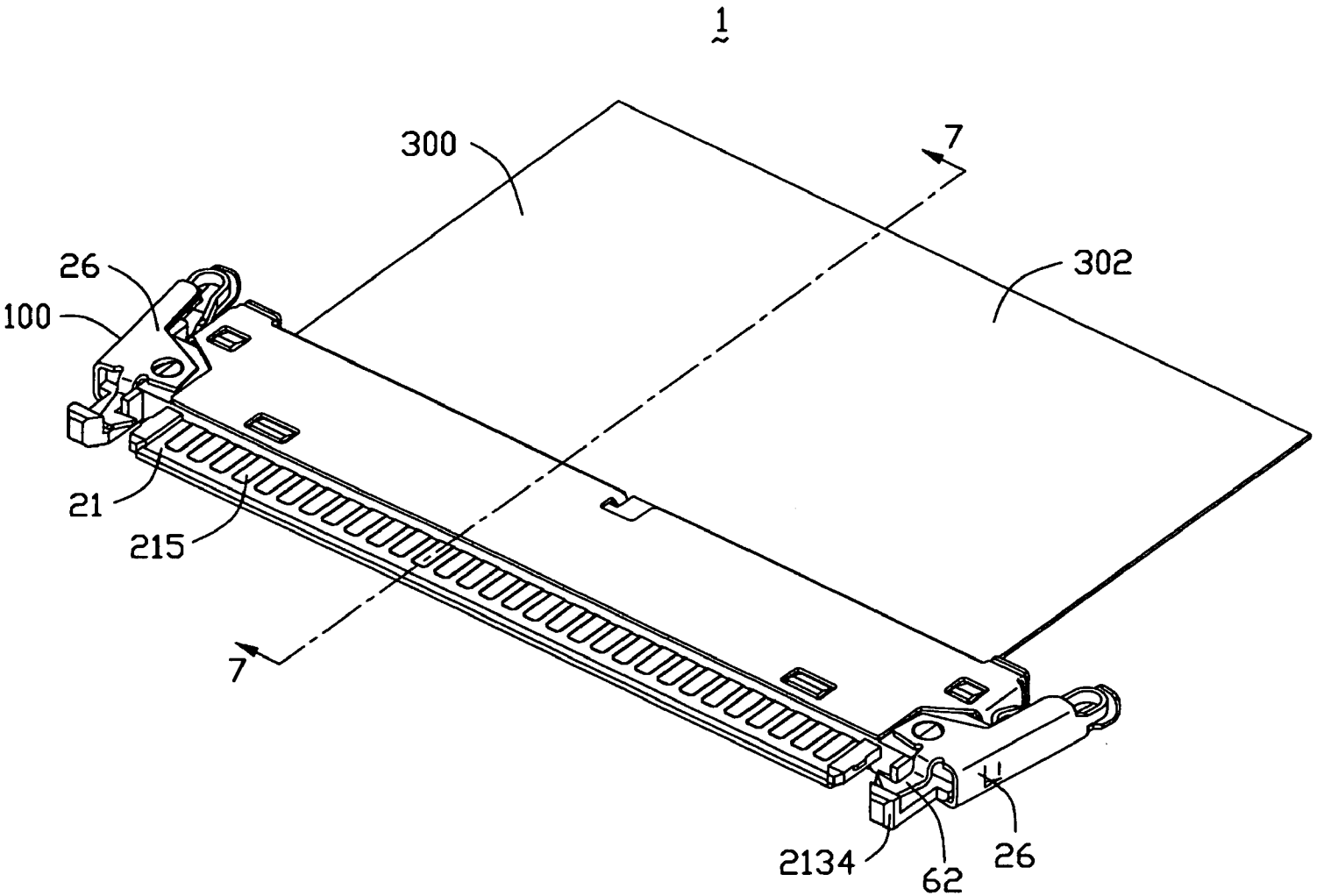
FIG. 1 is a perspective, assembled view of a cable connector assembly according to the present invention.

According to an exemplary embodiment of the present invention, shown in FIG. 1, the cable assembly 1 comprises an electrical connector 200 adapted for electrically connecting with a complementary connector (not shown), and a cable 300 electrically connected with the electrical connector 200. The connector 200 is a FFC connector due to its low profile, stable electrical properties and excellent preventing EMI (Electromagnetic Interference) function.

A structural description of the cable assembly 1 will now be described with reference to FIGS. 1–3. The connector 200 comprises an insulative housing 21, a contact set 22 having an insulative insert 23 and a plurality of terminals 24 for transmitting signals and power, a shield member 25 comprising a first metallic shield 251, a second metallic shield 252, and a pair of latch members 26.

The insulative housing 21 comprises an elongate base portion 211, a tongue portion 212 extending forwardly from middle region of the base portion 211, a termination portion 213 formed at a rear end of the base portion 211, and a pair of retention portions 214 respectively formed on lateral ends of the base portion 211. The base portion 211 and the tongue portion 212 together define a plurality of grooves 215 extending from the rear end of the base portion 211 to a front end of the tongue portion 212. The termination portion 213 comprises an elongated plate 2131 extending rearwardly from bottom edge of the base portion 211, a pair of U-shaped receiving sections 2132 formed on lateral ends of the elongated plate 2131. Each receiving section 2132 defines a receiving channel 2133 recessed outwardly from an inner side thereof. Each receiving section 2132 and a corresponding retention portion 214 define a gap 216 therebetween. Each retention portion 214 defines a depression 2141 in an outer wall thereof and a guiding portion 2142 extending forwardly therefrom. The guiding portion 2142 has an upright front end 2143 along a lengthwise direction and an upright lateral end 2144 extending from an inner side thereof along a lateral direction. The front end 2143 and the lateral end 2144 define an exit 2145 therebetween. The guiding portions 2142 are respectively spaced from the tongue portion 212 by a pair of cavities 217. Additionally, two pairs of first and second wedgy protrusions 2111 and 2134 are respectively formed on an upper surface of the base portion 211 and upper surfaces of the receiving sections 2132 of the termination portion 213. Two pairs of first and second slits 2112, 2135 are respectively defined in opposite sides of the base portion 211 and the receiving sections 2132 of the termination portion 213 adjacent to corresponding protrusions 2111, 2134. A pair of bolts 218 are defined at the opposite sides of the base portion 211 of the insulative housing 21.

Figure 6:
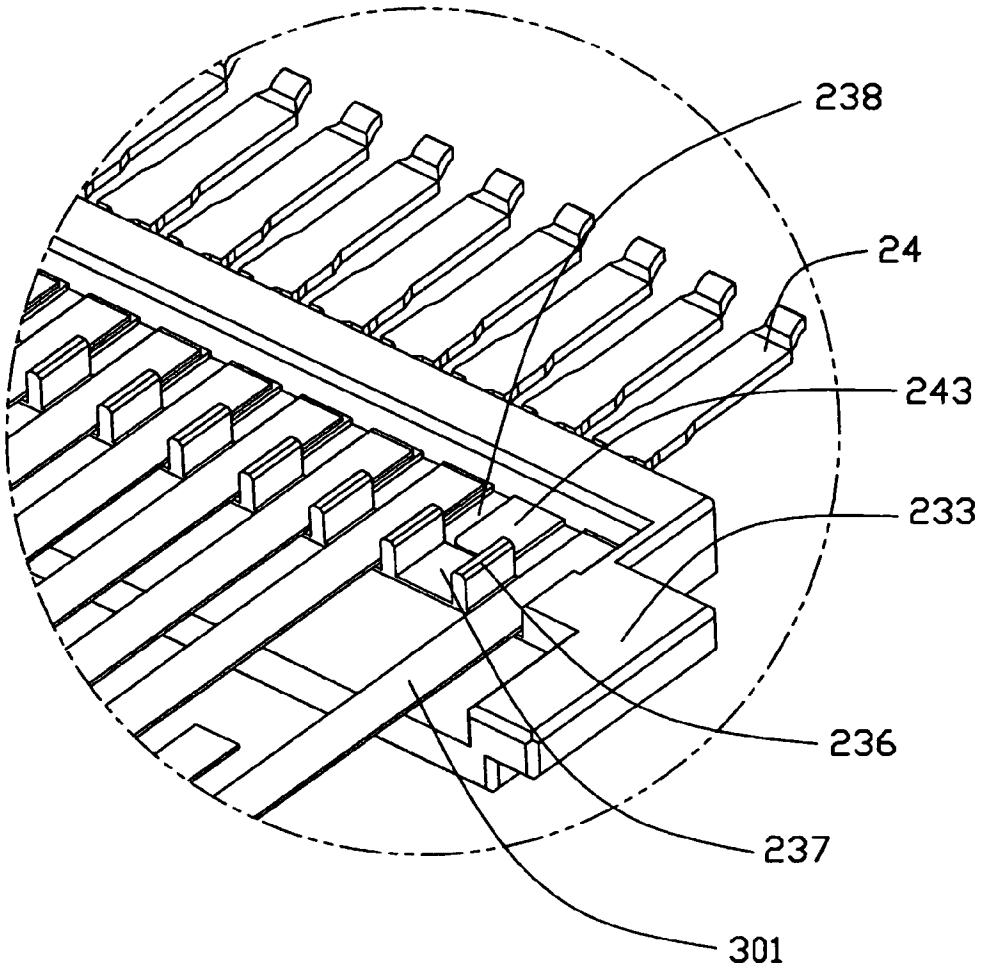
FIG. 6 is an enlarged view of the area shown in FIG. 4.
Figure 7:
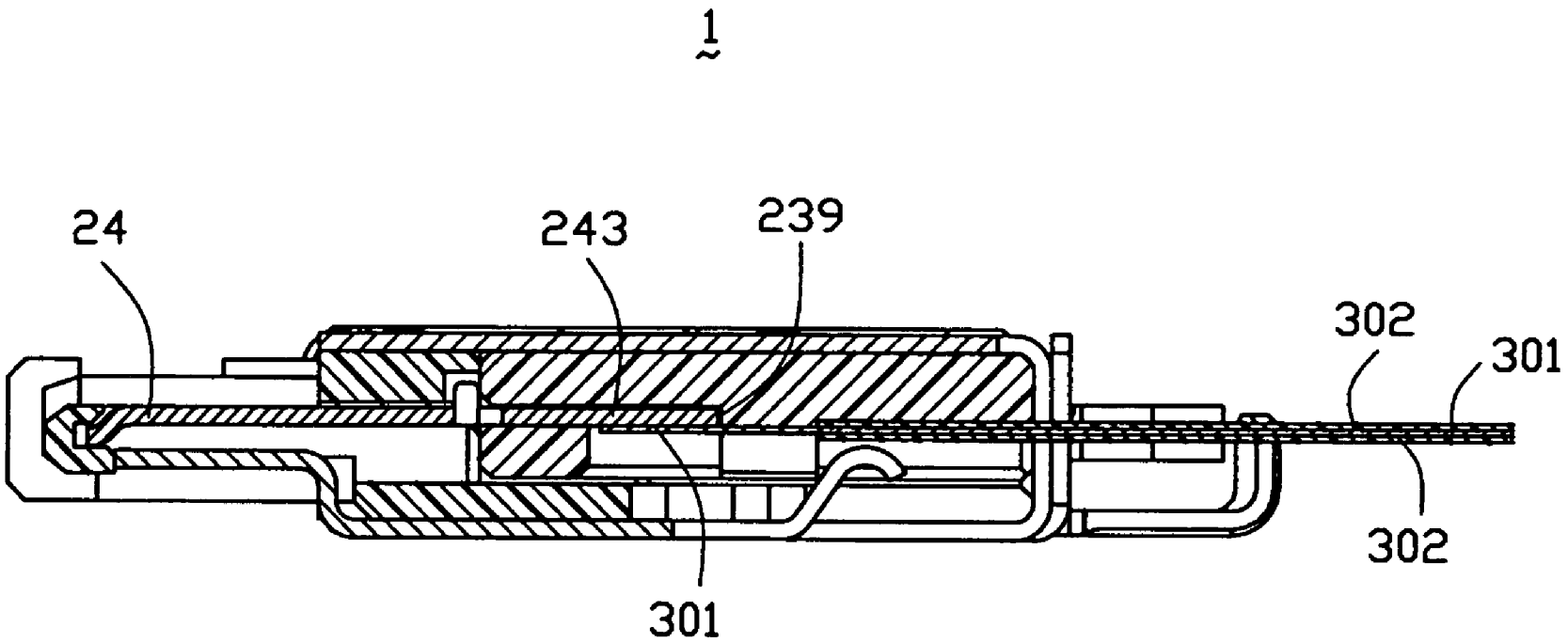
FIG. 7 is a cross-sectional view of the cable assembly along a line 7—7 of FIG. 1.
Figure 8:
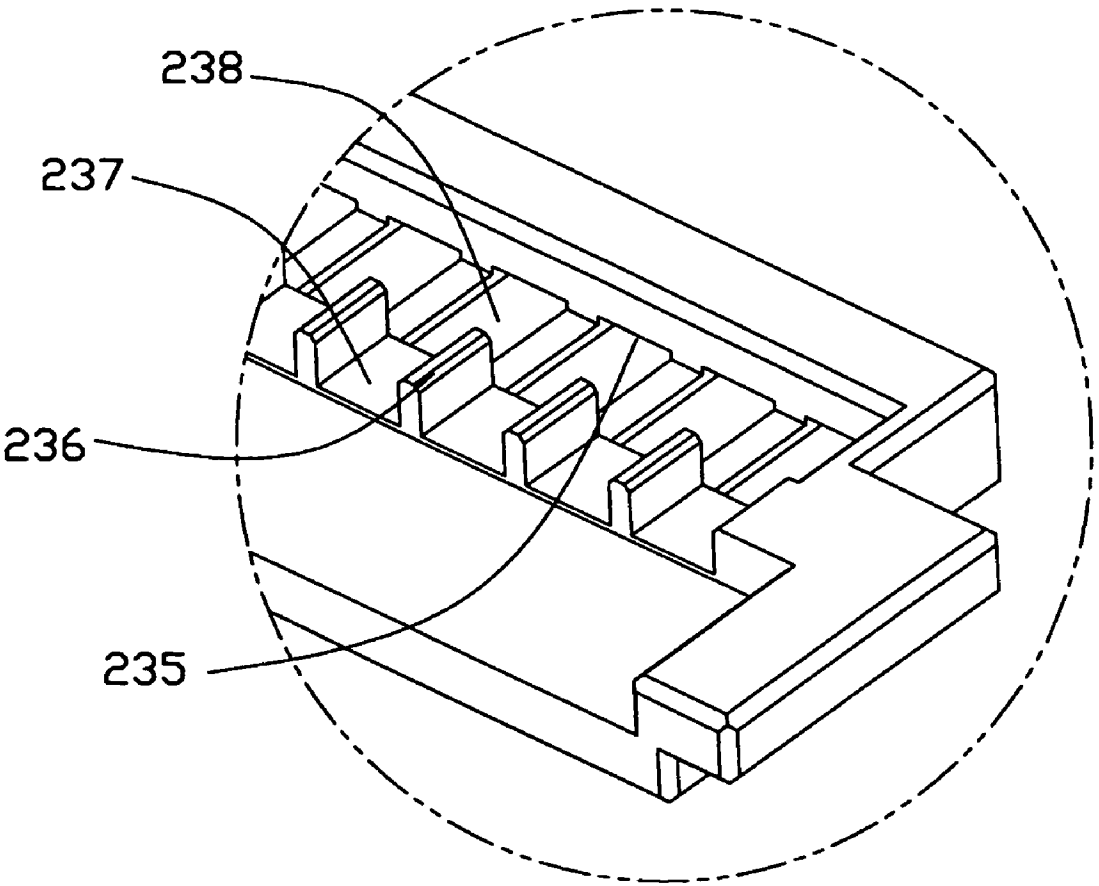
FIG. 8 is an enlarged view of the area shown in FIG. 3.

Join with the FIG. 6, the insulative insert 23 of the contact set 22 comprises an elongated main portion 231. The main portion 231 has a front face 232, a pair of end portions 233 and a depressing portion 234 behind the front face 232. The insulative insert 23 defines a plurality of holes 235 recessed rearwardly from the front face 232 thereof and arranged in a lateral direction. The depressing portion 234 forms a plurality of projections 236 in a middle thereof. Adjacent two projections 236 define a slit 237 therebetween. A plurality of slots 238 are defined behind corresponding holes 235 in a front-to-back direction perpendicular to the lateral direction. Each slot 238 is aligned with the corresponding hole 235 and the slit 237. The bottom surface of each slot 238 is higher than that of the slit 237, thus, forming a step 239 (shown in FIG. 7) therebetween.

Figure 4:
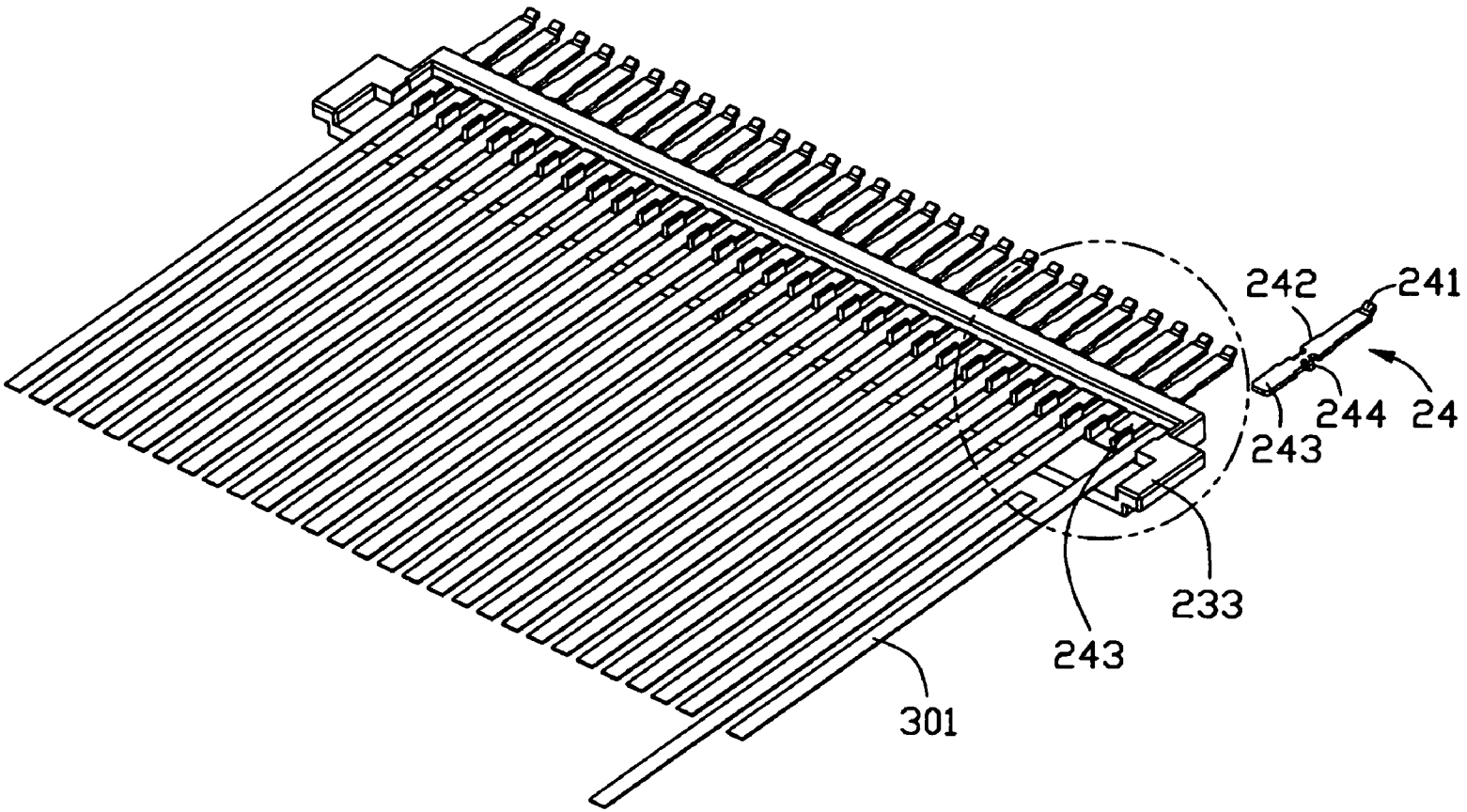
FIG. 4 is a partially assembled of FIG. 3, with bare conductive members of a cable to show detail structures more clearly.
Figure 5:
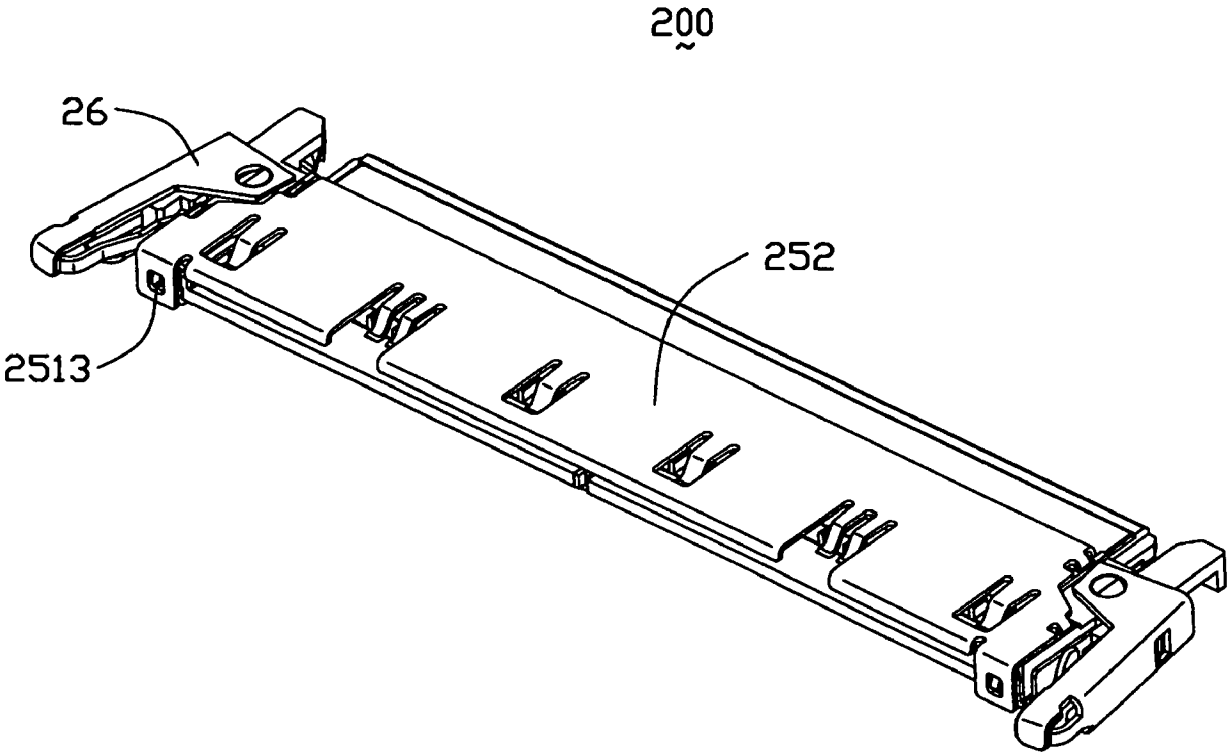
FIG. 5 is a perspective, assembled view of an electrical connector of the cable assembly of the present invention.

Referring to FIG. 4, the terminals 24 are respectively received in the insulative insert 23 and have the same configuration and dimensions. Each of the terminals 24 comprises a retention section 242 at middle thereof, a mating section 241 extending forwardly from the retention section 242, and a connecting section 243 extending rearwardly from the retention section 242. Furthermore, each retention section 242 has a pair of spines 244 protruding vertically from opposite sides thereof for locking with the housing 21.

The first metallic shield 251 and the second metallic shield 252 engage with each other and together define a space for receiving the housing 21 therein. The first shield 251 comprises a pair of side tabs 2511 extending downwardly from opposite lateral sides thereof and a pair of first flanges 2512 extending downwardly from a rear edge thereof. Each first flange 2512 forms a resilient bulge 2513 thereon. A pair of front apertures 2514 and a pair of side apertures 2515 are respectively defined in front and rear portions of the first shield 251 and respectively spaced from each other for respectively fitted with the first and the second protrusions 2111, 2134 of the housing 21. The second shield 252 comprises two pairs of side bars 2521 spaced arranged at opposite lateral edges thereof in the front-to-back direction to insert into the first and the second slits 2112, 2135 of the housing 21 and a pair of lower flanges 2522 which define pinholes 2523 for receiving the resilient bulges 2513 of the first flanges 2512.

The latch members 26 are respectively assembled to the retention portions 214 of the housing 21 and each comprises a substantially L-shaped main body 261 and a hook portion 262 in a configuration of a claw extending forwardly from the main body 261. The main body 261 comprises a top portion 2611, a bottom portion 2612 opposite to the top portion 2611 and a side portion 2613 connecting side edges of the top and bottom portions 2611, 2612. The top portion 2611, the bottom portion 2612, and the side portion 2613 together define a receiving space 2614. Each hook portion 262 extends through a corresponding cavity 217 of the housing 21. Two retention holes 2615 are defined through the top and bottom portions 2611, 2612 of the main body 261. A spring tab 264 extends rearwardly from a rear end of the side portion 2613 and in a direction away from an inner surface of the side portion 2613. An engaging tab 263 is formed with the side portion 2613 and extends inwardly for locking in the depression 2141 defined in the outer wall of the corresponding retention portion 214.

Figure 2:
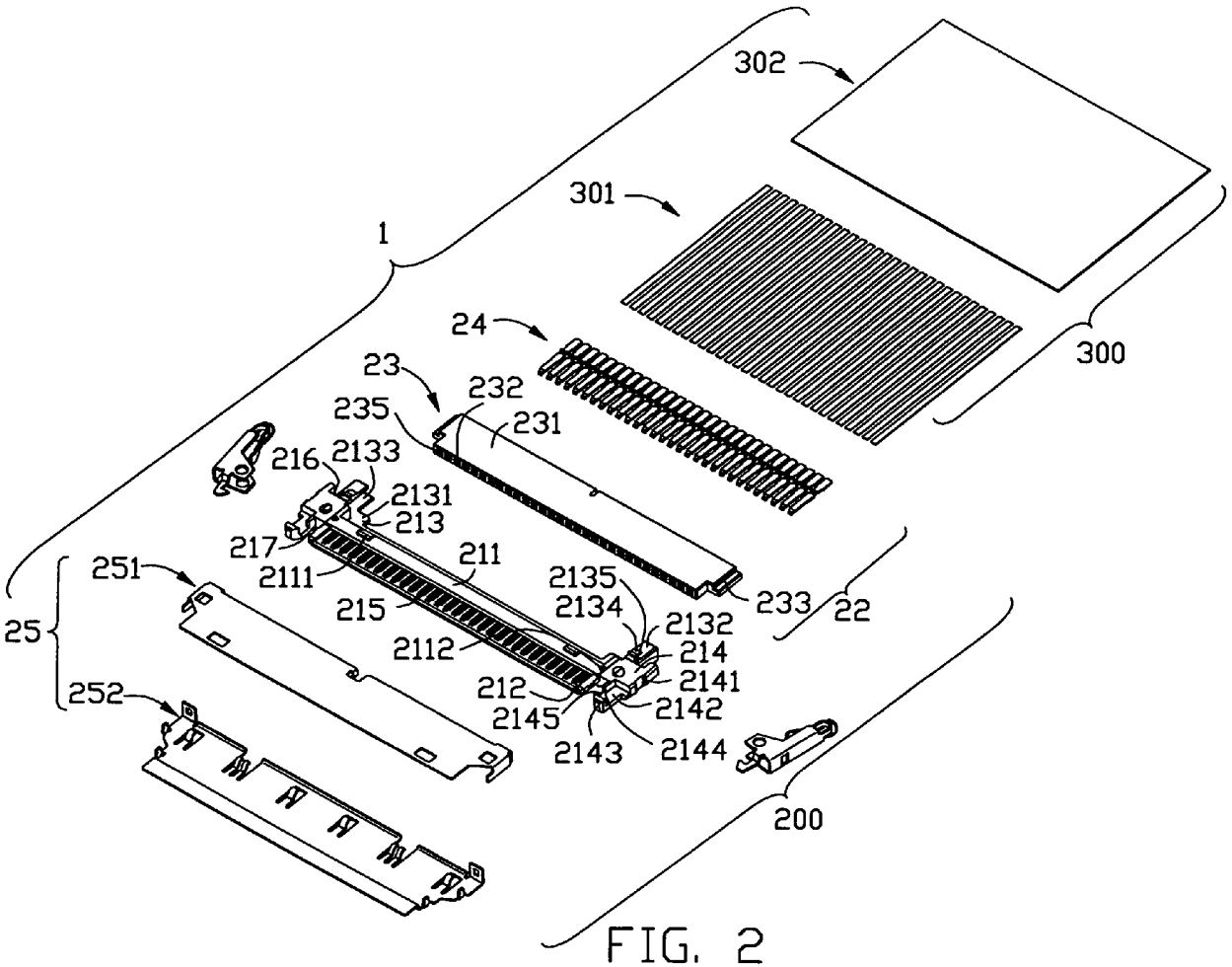
FIG. 2 is an exploded, perspective view of FIG. 1.
Figure 3:
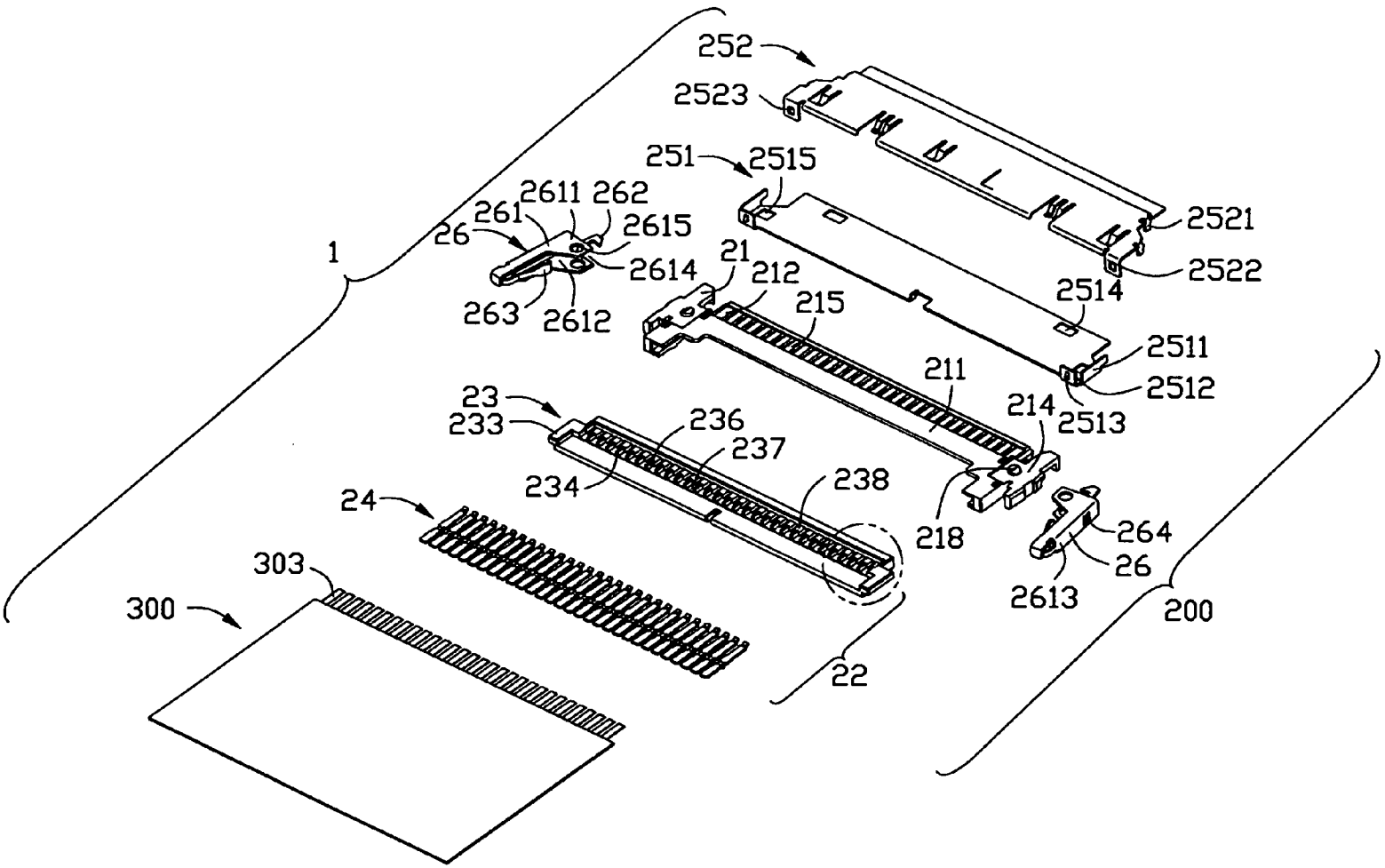
FIG. 3 is another view of the FIG. 2.

Referring to FIG. 2 and FIG. 3, a structural description of the cable 300 will be given hereinafter.

The cable 300 comprises a plurality of separated conductive members 301 and a pair of insulative layers 302 respectively attaching to opposite surfaces of the conductive members 301. The contacting portion of each conductive member 301 being disposed out of the layers 302 forms a contacting portion 303.

Referring to FIGS. 1–8 together, the terminals 24 of the electrical connector 200 are respectively inserted into the holes 235 formed in the insert 23 The connecting sections 243 extend through the corresponding holes 235 until rear edges thereof abut against the steps 239. Therefore, the connecting section 243 of the terminal 24 is partially received in corresponding hole 235 and partially received in corresponding slot 238 at the depressing portion 234. The bottom surface of the connecting section 243 of the terminal 24 flushes with the bottom surface of corresponding slit 237, slots 235. The front portion 303 of the cable 300 is positioned at the depressing portion 234 with the contacting portions 303 extending into the corresponding slits 237 and positioned below the connecting portions 243 of the terminals 24, respectively. The contacting portions 303 are soldered onto the corresponding connecting portions 243 of the terminals 24 in the slot area.

The assembled insert 23 and the terminals 24 are assembled to the elongate plate 2131 of the termination portion 213 of the housing 21 with the end portions 233 received in the receiving channels 2133 of the receiving sections 2132, and the retention sections 242 and the mating sections 241 of the terminals 24 inserted into the grooves 215 of the tongue portion 212. The spines 244 have an interferential fit with the housing 21. Next, the shield member 25 is assembled to the housing 21. The first shield 251 is assembled to the housing 21 with the first and second protrusions 2111, 2134 fitted into the apertures 2514, 2515, and the side tabs 2511 engagingly received in the gaps 216. The second shield 252 is assembled to the housing 21 with the side bars 2521 inserted into the first and second slits 2112, 2135. The first shield 251 and the second shield 252 are fixed together by the resilient bulges 2513 on the upper flanges 2512 engaging with the pinholes 2523 defined in the second flanges 2522. Next, the latch members 26 are assembled to the housing 21 in a position where the body portions 261 warp the retention portions 214, and the hook portions 262 locate on the guiding portions 2142 with free end thereof extending into the exit 2145 of the guiding portions 2142. The bolts 28 are fitted into the retaining holes 2615 so that the latch members 26 are pivotally mounted on the second housing 21. The engaging tabs 263 extend into the gaps 216 and resiliently abut against the side tabs 2511 of the first shield 251. The engaging tabs 264 are engagingly received in the depressions 2141.

During the cable 300 is soldered to the corresponding terminals 24, the conductive members 301 are located on the co-surface of the slits 237 and the connecting portions 243 of the terminals 24 with adjacent projections 236 restricting the movement of the conductive members 301 in the lateral direction. So that, the cable 300 is more easily and precisely soldered to the terminals 24.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable assembly, comprising:

an electrical connector comprising an insulative housing and a plurality of terminals partially received in the insulative housing;

an insert being assembled to the insulative housing of the electrical connector and comprising a plurality of holes formed in a front portion thereof and a depressing portion formed at a rear portion thereof, the depressing portion forming a plurality of projections arranging along a lateral direction, and separated with a front face in a front-to-back direction, accordingly, a transverse slot being forming between the front face and the projections, every two projections forming a slit therebetween, the slot aligned with and communicating with corresponding holes and slits; and a Flat Flexible Cable comprising a plurality of separated conductive members, the front ends of the separated conductive members disposed in the slits and the slots, and wherein each terminal comprises a connecting section disposed in the slot of the insert, and is soldered with corresponding conductive member of the Flat Flexible Cable in the slot area; wherein the bottom surface of slot is higher than that of the slit, and wherein forming a step is formed between the slot and the slit; wherein the connecting section, the connecting section is partially received in holes and partially received in the corresponding slots, and wherein the bottom surface of each connecting section flushes with the bottom surface of corresponding slit.

2. The cable assembly as claimed in claim 1, wherein the terminal comprises a retention section at middle thereof, a mating section extending forwardly from the retention section and received in the housing, and the connecting section extending rearwardly from the retention section.

3. The cable assembly as claimed in claim 2, wherein each retention section has a pair of spines protruding outwardly for locking with the housing.

4. The cable assembly as claimed in claim 3, wherein the retention sections are inserted into the insulative housing and engage with the housing.

5. The cable assembly as claimed in claim 4, wherein the housing has a termination portion at a rear end of the base portion, and wherein the insert is assembled to the, housing to engage with the termination portion.

6. The cable assembly as claimed in claim 5, wherein the termination portion comprises a pair of receiving channels, the insert comprises a pair of end portions, and wherein the end portions are received in the receiving channels, respectively.

7. The cable assembly as claimed in claim 5, wherein the insulative housing comprises a pair of retention portions at opposite side thereof, the electrical connector comprises a pair of latch members respectively assembled to the retention portions of the housing and each latch member comprises a main body and a hook portion in a configuration of a claw extending rearwardly from the main body.

8. The cable assembly as claimed in claim 1, wherein the electrical connector comprises a shield member assembled on the insulative housing.

9. The cable assembly as claimed in claim 8, wherein the shield member comprises a first shield and a second shield, and the first and the second shield engage with each other and are assembled to the insulative housing.

10. A cable assembly comprising:

an insulative housing having a base portion and a tongue portion perpendicularly extending from the base portion, the base portion and the tongue portion together define a plurality of grooves therethrough;

a plurality of terminals received in the grooves, each having a mating section retained in the tongue portion and a connecting section extending beyond rear end of the base portion;

an insert comprising a transverse slot and a plurality of slits communicating with slot, the terminals partially received in the slot;

a Flat Flexible Cable comprising a plurality separated conductive members extending through the slits to the slots of the insert, and electrically connecting with the terminals; and a metallic shield assembled on the housing; wherein the insert comprises a front face, and a depressing portion behind the front face; wherein the depressing portion forms a plurality of projections arranged in a lateral direction, and separated with the front face in a front-to-back direction, every two projections defines the slit, said slots is located between the front face and the slits in the front-to-back direction; wherein each terminal does not enter into the slit; wherein the bottom surface of each terminal flushes with the bottom surface of corresponding slit.

11. The cable assembly as claimed in claim 10, wherein the shield comprises an first shield and a second shield, the first shield having a first flange forming a resilient bulge thereon, and wherein the second shield has a second flange defining a pinhole for receiving the resilient bulge to joint the first and second shield together.

12. The cable assembly as claimed in claim 11, wherein the first shield defines a plurality of apertures, and wherein the housing forms a plurality of protrusions for engagingly received in the apertures.

13. The cable assembly as claimed in claim 11, wherein the second shield forms a plurality of side bars extending upwardly from lateral ends thereof, and wherein the housing defines a plurality of slits for engagingly receiving the side bars.

* * * * *